US005551520A

United States Patent [19]

Bethel et al.

[11] Patent Number: 5,551,520

[45] Date of Patent: Sep. 3, 1996

[54] DUAL REDUNDANT DETONATING SYSTEM FOR OIL WELL PERFORATORS

[75] Inventors: Robert K. Bethel; Michael B. Grayson; James Ellis, all of Houston, Tex.

[73] Assignee: Western Atlas International, Inc., Houston, Tex.

[21] Appl. No.: 501,480

[22] Filed: Jul. 12, 1995

[51] Int. Cl.[6] ..... E21B 43/117; E21B 43/1185

[52] U.S. Cl. ..... 175/4.54; 175/4.56; 175/4.6

[58] Field of Search ..... 166/297, 55; 175/4.54, 175/4.56, 4.6

[56] References Cited

U.S. PATENT DOCUMENTS

| | | | |
|---|---|---|---|
| 4,650,009 | 3/1987 | McClure et al. | 175/4.6 |
| 4,836,109 | 6/1989 | Wesson et al. | 102/312 |
| 4,901,802 | 2/1990 | George et al. | 166/287 |
| 5,103,912 | 4/1992 | Flint | 166/297 |
| 5,287,924 | 2/1994 | Burleson et al. | 166/55 |
| 5,355,957 | 10/1994 | Burleson et al. | 166/297 |

*Primary Examiner*—Stephen J. Novosad
*Attorney, Agent, or Firm*—Richard A. Fagin

[57] ABSTRACT

The invention is an apparatus for initiating a wellbore perforator comprising a first firing head for generating a first explosive signal when a first actuation signal is applied to the first firing head, a second firing head for generating a second explosive signal when a second actuation signal is applied to the second firing head, a first means for transferring the first explosive signal to shaped charges in the perforator including a first bulkhead interposed between the shaped charges and the first means for preventing transfer of low order initiation of the first means to the shaped charges, and a second means for transferring the second explosive signal to the shaped charges including a second bulkhead interposed between the shaped charges and the second means for preventing transfer of low order initiation of the second means to the shaped charges.

8 Claims, 4 Drawing Sheets

(Continue in Fig. 2B)

DUAL REDUNDANT DETONATING SYSTEM FOR OIL WELL PERFORATORS

BACKGROUND OF THE INVENTION

1. Field of the Invention

The present invention is related to the field of oil well perforating systems. More specifically, the present invention is related to systems for transferring detonating signals from an explosive initiator to shaped charges in a well perforating gun assembly.

2. Description of the Related Art

Wellbores drilled through earth formations for extracting oil and gas are typically completed by coaxially inserting a steel pipe, called casing, into the wellbore. The earth formations are put in hydraulic communication with the wellbore by making holes, referred to as perforations, in the casing. Perforations are typically made in the casing by detonating explosive shaped charges inside the casing at a depth adjacent to the earth formation which is to produce the oil and gas: Shaped charges are configured to direct the energy of an explosive detonation in a narrow pattern, called a "jet", which creates the hole in the casing.

The shaped charges are initiated by a detonating signal which is transferred from an initiator, through a hollow metal, cloth or plastic tube filled with high explosive. The initiator can be a lead-azide type electrical blasting cap, an electrically-activated exploding bridegewire ("EBW") initiator, an electrically activated exploding-foil initiator ("EFI") or a percussively-activated explosive initiator. The explosive-filled tube is generally referred to as "detonating cord". A type of detonating cord known in the art is sold by the Ensign-Bickford Company under the trade name "PRIMACORD".

The percussively-activated explosive type initiator is typically used in oil well perforating systems known as "tubing conveyed" systems. As is known to those skilled in the art, tubing conveyed perforating systems are used to create perforations in oil wells without requiring insertion of an electric wireline into the wellbore. As is also known by those skilled in the art, creating perforations without a wireline inserted into the wellbore enables initiation of the shaped charges, and consequently creation of the perforations, while the wellbore has an internal pressure significantly less than the fluid pressure of the oil and gas within the earth formation, so that the perforations can have increased hydraulic efficiency.

The percussively-activated initiator in a tubing-conveyed system can be activated by dropping a rod or "bar" from the earth's surface, through the wellbore, onto the initiator. Another version of percussive initiator, called a "pressure activated" initiator, includes a piston restrained by shear pins inside a housing. The housing is sealed against wellbore pressure on one side, and the back side of the piston is exposed to the pressure present in the wellbore through the open end of the housing. Fluid pressure can be applied to the wellbore at the earth's surface to the wellbore. The pressure is communicated to the back side of the piston until the hydraulic force on the piston exceeds the shear strength of the pins. When the shear pins break, the piston is released so that it can travel and strike the initiator, initiating the explosion in a manner similar to the dropped bar initiator.

The initiators known in the an occasionally fail to detonate the shaped charges because the high explosive in the initiator and/or the detonating cord burns instead of exploding. This type of failure is referred to as a "low order" failure. A particular difficulty with tubing-conveyed systems which undergo low order failure is that a booster explosive, which transfers the detonating signal from the detonating cord to the top of a gun carrier containing the shaped charges, can be damaged by the low order burning of the detonating cord. If the booster explosive is damaged by low order failure, then the entire gun carrier must typically be retrieved from the wellbore, disassembled and reloaded, which can be difficult and expensive.

Tubing-conveyed perforating systems known in the art typically provide a second initiator so that if the first initiator and its associated detonating cord fail to detonate the shaped charges, the failure can be overcome by activating the second initiator. Such systems are referred to as redundant firing head systems. A drawback to the redundant firing head systems known in the art is that low order failure of the first initiator can damage the booster explosive, so that even if the second initiator detonates properly, the detonating signal may not transfer to the shaped charges.

It is known in the art to prevent damage to the booster explosive by providing a barrier between the booster explosive and the detonating cord. The barrier can be penetrated by a shaped charge disposed at the end of the detonating cord which can explosively penetrate the barrier only upon proper "high-order" initiation of the detonating cord. Such a barrier system is described, for example in U.S. Pat. No. 4,650,009 issued to McClure et al. The system in the McClure et al '009 patent, however, is intended to be used either with a single initiator and detonating cord, or to transfer the detonating signal along a single explosive path through serially connected gun sections. The system in the McClure et al '009 patent is not suitable for use in redundant firing head systems because it only includes a single shaped charge. Low-order failure of the first initiator could damage the shaped charge so that even a proper high-order detonation of the second initiator would fail to cause detonation of the shaped charge, preventing normal detonation of the gun assembly.

Accordingly, it is an object of the present invention to provide a redundant firing head perforator system that can detonate shaped charges even after a low-order failure of the first explosive initiator and/or detonating cord.

SUMMARY OF THE INVENTION

The present invention is an apparatus for initiating a wellbore perforator comprising a first firing head for generating a first explosive signal when a first actuation signal is applied to the first firing head, and a second firing head for generating a second explosive signal when a second actuation signal is applied to the second firing head. The apparatus includes a first means for transferring the first explosive signal to shaped charges in the perforator. The first means includes a first bulkhead interposed between the shaped charges and the first means for preventing transfer of low order initiation of the first means to the shaped charges. The apparatus includes a second means for transferring the second explosive signal to the shaped charges. The second means includes a second bulkhead interposed between the shaped charges and the second means for preventing transfer of low order initiation of the second means to the shaped charges.

In a specific embodiment of the invention, the first firing head comprises a "drop bar" percussively actuated firing head, and the second firing head comprises a pressure actuated firing head.

In a particular embodiment of the invention, the second firing head comprises a time delay interposed between the second firing head and the second means for transferring the second explosive signal.

DESCRIPTION OF THE PREFERRED EMBODIMENT

Figure 1:
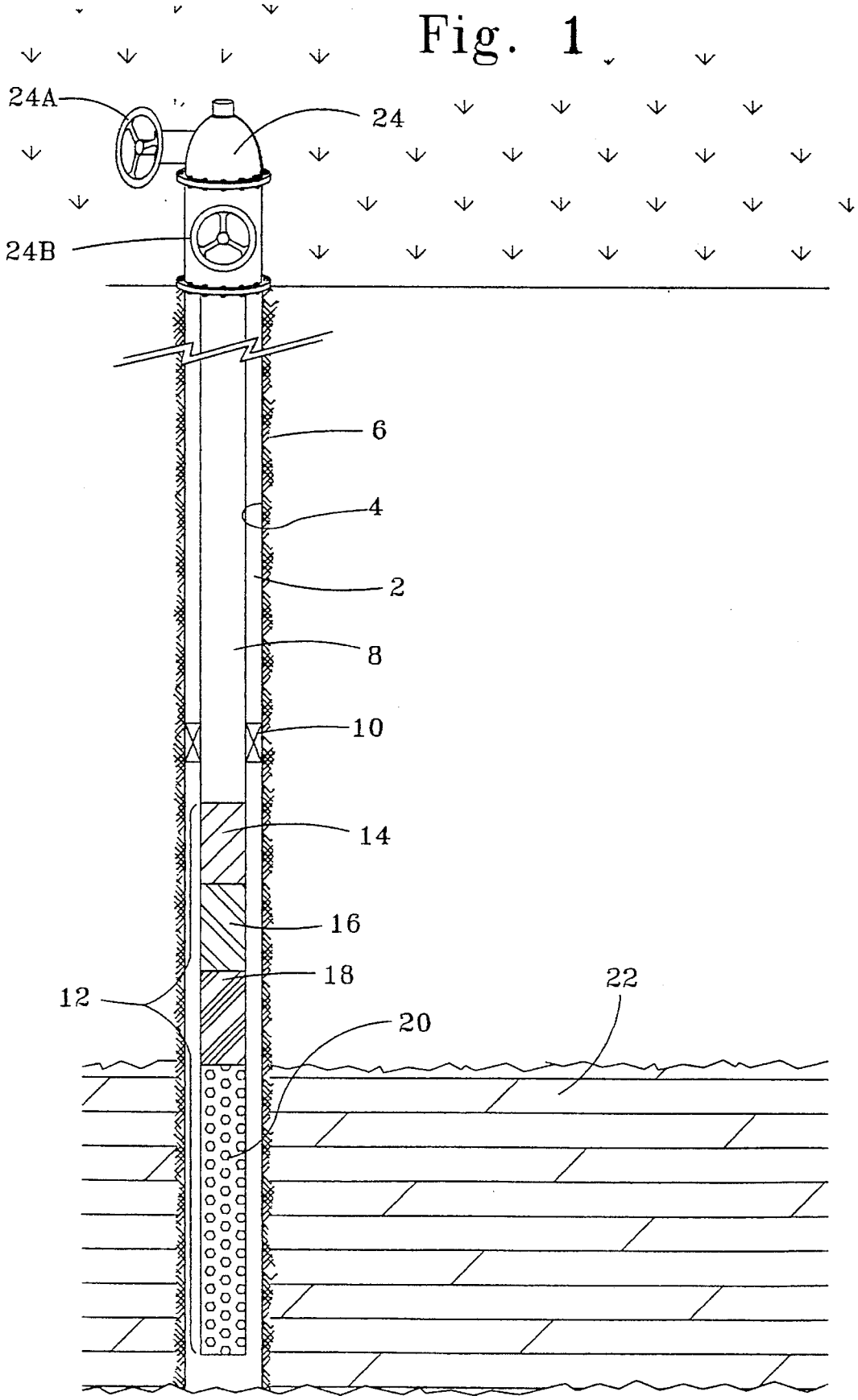
FIG 1 shows a tubing conveyed wellbore perforator disposed in a wellbore.

The present invention can be better understood by referring to FIG. 1. A wellbore 2 drilled through the earth penetrates a formation 22 containing oil and gas. The wellbore 2 is typically completed by coaxially inserting a steel pipe, called casing 4, into the wellbore 2 at least through the formation 22. The casing 4 can be hydraulically sealed to its exterior by pumping cement, shown generally at 6, into the annular space between the wellbore 2 and the casing 4.

The wellbore 2 includes a "tubing string" 8 coaxially inserted inside the casing 4. As is understood by those skilled in the art, the purpose of the tubing string 8 is to increase the velocity of fluids which may be produced from the formation 22 so that denser liquids, such as water, which may be produced from the formation 22 can be carried to the earth's surface along with oil and gas. The outside of the tubing string 8 is typically sealed against the inside of the casing 4 by an annular seal called a packer, shown generally at 10. The tubing 8 and the casing 4 terminate at the earth's surface in a wellhead 24. As is understood by those skilled in the art, the wellhead 24 typically includes valves 24A, 24B to control fluid flow from the tubing 8 and from the annular space between the tubing 8 and the casing 4.

The packer 10 can include production equipment attached to its bottom end. In the present invention, the production equipment can include a tubing-conveyed perforator, shown generally at 12. As is understood by those skilled in the art, the perforator 12 comprises a sealed gun housing 20 containing shaped explosive charges (not shown separately for clarity of the illustration) and a detonating cord (not shown) for conducting an explosive detonating signal originating from a "firing head" to each one of the shaped charges, as will be further explained.

The perforator 12 typically includes a first tiring head 16. The first firing head 16 generates an explosive signal when a "bar" (not shown) is dropped by the system operator from the earth's surface through the tubing string 8 until the bar contacts a percussive initiator (not shown separately) forming part of the first firing head 16. Alternatively, the first firing head 16 can include a pressure actuated initiator (not shown) which causes the first firing head 16 to generate the explosive signal when pressure exceeding a predetermined amount is applied to the firing head 16 from the earth's surface. Both the "drop bar" and pressure actuated initiators are known in the art.

The perforator 12 of the present invention also includes a second firing head 18. The second firing head 18 typically includes a pressure actuated initiator, as previously described herein. The second firing head 18 can be provided to insure detonation of the perforator 12 in the event that the first tiring head 16 fails to cause detonation of the perforator 12.

The perforator 12 can also include a flow sub, shown generally at 14. The flow sub 14 can be opened either by application of a predetermined pressure to the tubing string 8 or by the previously described bar drop used to initiate the first firing head 16, if the first firing head 16 is of the type which is initiated by the drop bar.

As is understood by those skilled in the art, the wellbore 2 can be placed in hydraulic communication with the formation 22 by detonating the perforator 12. When the perforator 12 is detonated, the shaped charges (not shown) in the housing 20 explosively create holes, or perforations, through the casing 4, the cement 6 and at least some of the formation 22. Detonating the perforator 12 is generally accomplished by actuating the first firing head 16, as previously described. If the first firing head 16 fails to cause detonation, the second firing head 18 can be initiated by applying a predetermined amount of pressure to the tubing string 8.

Figure 2A:
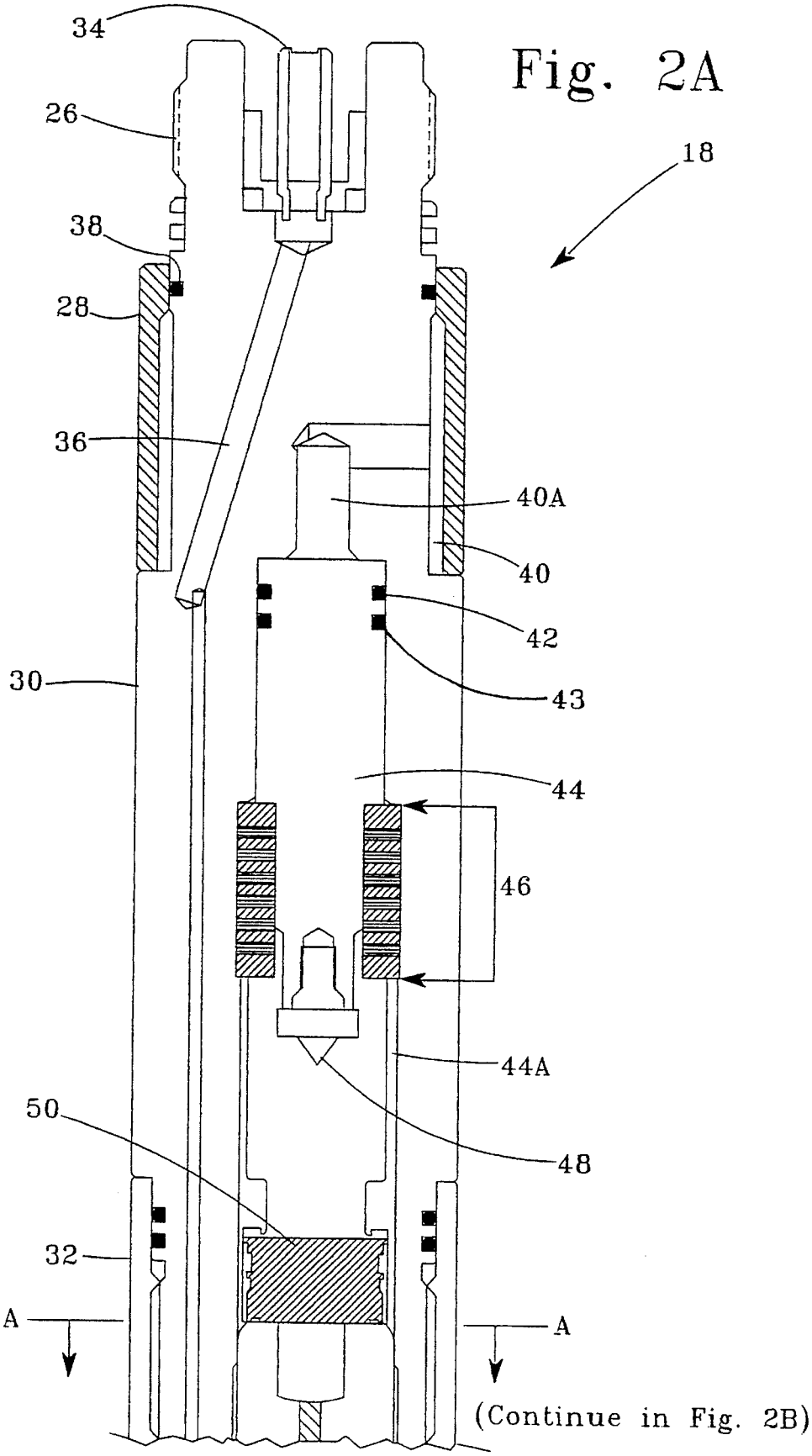
FIG 2A–C shows the apparatus of the present invention in more detail.
Figure 2B:
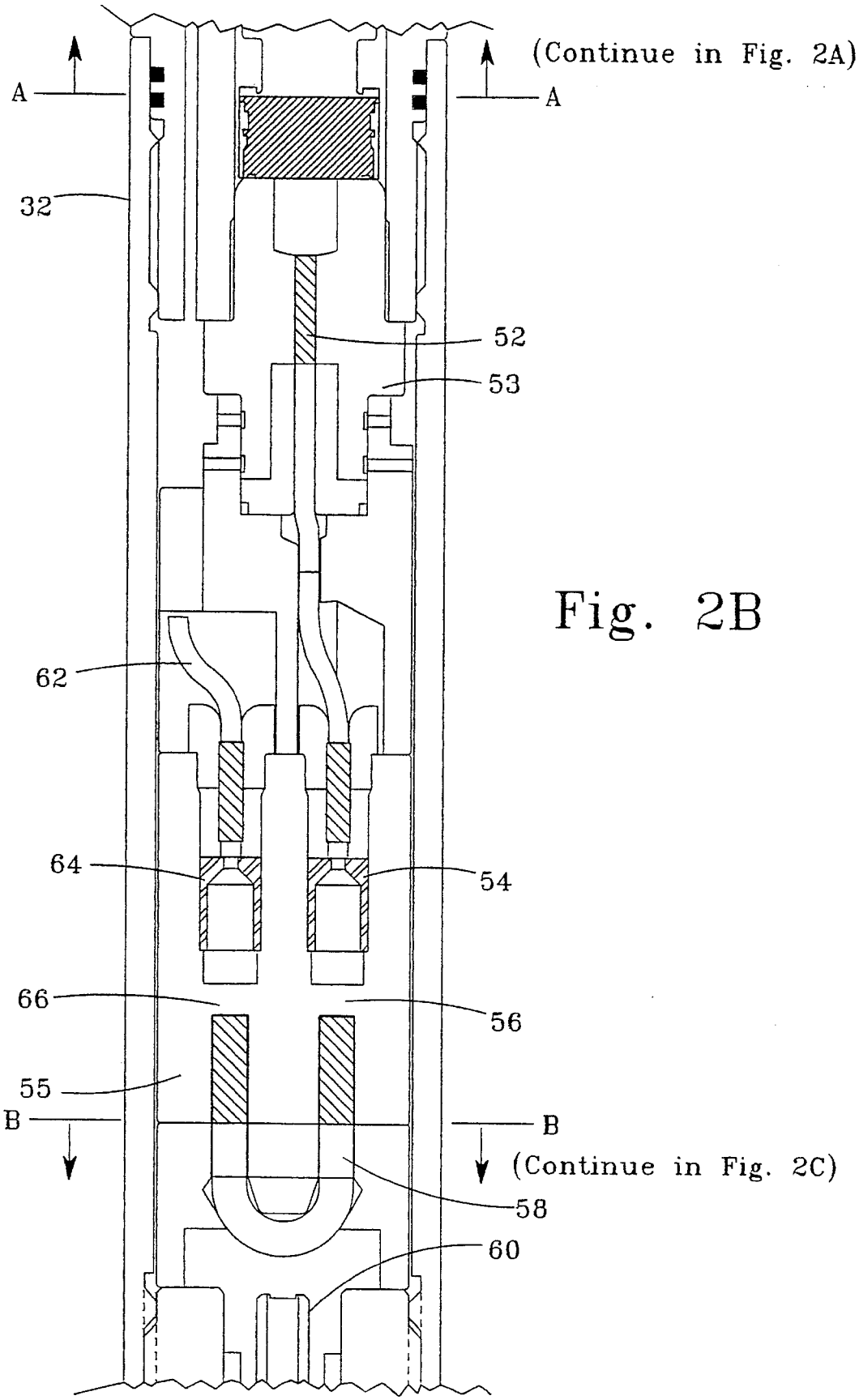
Figure 2C:
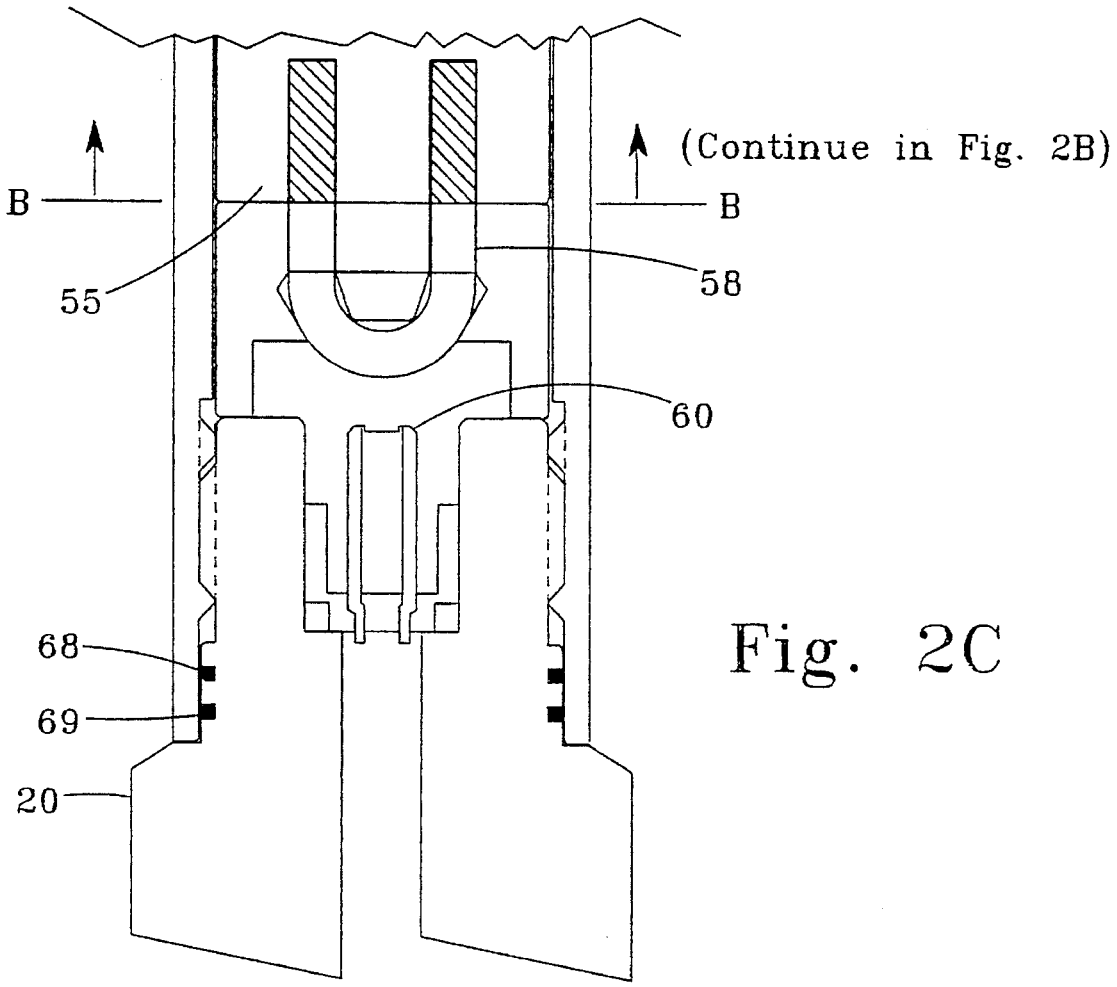

The particular advantages of the present invention can be better understood by referring to FIG. 2. The second firing head 18 is shown in FIG. 2 in more detail. The second firing head 18 includes a connector sub 26 which makes mechanical connection to the first firing head (shown in Figure 1 as 16). A first detonation transfer charge 34 is shown generally in the center of the connector sub 26 and located near the top of the sub 26. The first transfer charge 34 can be of a type known in the an comprising high explosive such as RDX or HMX. The first transfer charge 34 receives an explosive detonating signal generated by the first firing head (16 in FIG. 1 ) and explosively conducts the detonating signal to a first detonating cord 62. The first detonating cord 62 can be of a type familiar to those skilled in the art, such as a high explosive filled, flexible tubing sold by the Ensign-Bickford company under the trade name "PRIMACORD".

The first detonating cord 62 is positioned inside a first channel, shown generally at 36. The first channel 36 is drilled through the connector sub 26 and a bulkhead sub 55 connected to the bottom end of the connector sub 26. The first channel 36 isolates the force of detonation of the first detonating cord 62 so that the detonation, or combustion in the case of a "low-order" failure of the first detonating cord 62, does not initiate or damage a second detonating cord 52, as will be further explained. The first detonating cord 62 terminates at a first initiator shaped charge 64 positioned in a channel in the bulkhead sub 55. If the first detonating cord 62 does not explosively detonate, or if it undergoes a "low order" failure, the first initiator charge 64 will not be explosively detonated, and a first bulkhead 66 positioned under the first initiator charge 64 will remain intact. The significance of the first bulkhead 66 remaining intact will be further explained. Proper detonation of the first detonating cord 62, on the other hand, causes explosive initiation of the first initiator shaped charge 64, which then explosively penetrates the first bulkhead 66. The explosive penetration of the first bulkhead 66 initiates a detonation transfer cord 58, which can be formed from a length of material similar to the first detonating cord 62.

The operative part of the second firing head 18 comprises a piston 44 positioned inside a cylinder 44A. The cylinder 44A is formed generally in the center of the connector sub 26. The piston 44 can be sealed against the inside of the cylinder 44A by o-rings 42, 43. One side of the piston 44 is exposed to pressure external to the perforator (12 in FIG. 1) through a port 40A in the upper part of the cylinder 44A. The port 40A hydraulically connects to the outside of the perforator 12 through a passage 40 in the wall of the connector sub 26. The passage 40 can be protected from fluids in the wellbore (2 in FIG. 1 ) by a cover sleeve 28 which is sealed by an o-ring 38. The passage 40 and the cover sleeve 28 together form a siphon break which can be filled with fluids such as water or silicone grease at the earth's surface to prevent fluids in the wellbore from entering the passage 40 when the perforator (12 in FIG. 1) is inserted into the wellbore (2 in FIG. 1).

The piston 44 is restrained from movement within the cylinder 44A by a set of shear pins 46. The shear pins 46 are designed to break upon application of a predetermined force from the piston 44. By designing the shear pins to break at a predetermined amount of three, it is possible to cause the piston 44 to move upon application of a predetermined amount of pressure.

The bottom of the piston 44 includes a firing pin 48. When sufficient pressure is applied to the port 40, the piston 44 breaks the shear pins 46, and moves downward. The firing pin 48 is forced into contact with a percussively activated explosive 50 located at the bottom of the connector sub 26 and initiates the explosive 50. The percussively activated explosive 50 can be a type known in the art.

Initiation of the percussively activated explosive 50 in turn causes initiation of the second detonating cord 52. The second detonating cord 52 is positioned in a passage in a retaining sub 53 attached to the bottom of the connector sub 26. Alternatively, the percussive explosive 50 can be substituted by a percussively initiated pyrotechnic time delay (not shown) interposed between the tiring pin 48 and the explosive 50. The time delay (not shown) can in turn initiate the explosive 50, which then initiates the second detonating cord 52. A time delay suitable for use in the present invention is described, for example in U.S. Pat. No. 4,614,156 issued to Colle et al. As is understood by those skilled in the art, the time delay (not shown) enables the system operator to bleed off the pressure applied to the tubing (8 in FIG. 1) used to activated the second firing head 18. After the time delay has expired, initiation of the second detonating cord 52 and the perforator (12 in FIG 1 ) can then proceed with minimal pressure inside the wellbore 2.

As previously explained, the second detonating cord 52 is isolated from the first detonating cord 62 so that burning or explosive detonation of the first detonating cord 62 will not cause initiation of, or damage to, the second detonating cord 52. The second detonating cord 52 terminates at a second initiator shaped charge 54 located in another channel in the bulkhead housing 55. The second initiator charge 54 can be substantially the same type as the first initiator charge 64. The second initiator charge 54 is positioned above a second bulkhead 56 so that explosive detonation of the second detonating cord 52 will cause actuation of the second initiator charge 54. Actuation of the second initiator charge 54 will cause explosive penetration of the second bulkhead 56. The transfer cord 58 can be formed into a U-shape, as shown in FIG. 2, so that its other end is exposed to the penetrating explosion of the second initiator charge 54 and thereby will be initiated upon penetration of the bulkhead 56 by either the first 64 or the second 54 initiator charge.

Detonation of the transfer cord 58 causes initiation of a second transfer charge 60 which is located at the top of the housing (20 in FIG. 1) containing the shaped charges (not shown) which perforate the casing (4 in FIG. 1). The second transfer charge 60 can be of substantially the same type as the first transfer charge 34.

The bulkhead housing 55, the retainer housing 53, and all the components previously described herein as positioned within either of them, can be contained in a firing head housing 32. The firing head housing 32 is sealingly connected at one end to the bottom of the connector sub 26, and at the other end to the upper end of the perforator housing 20.

A significant advantage offered by the present invention is that a low-order failure of the first detonating cord 62 will not damage the transfer cord 58 or the second transfer charge 60 because the low-order failure will not penetrate the first bulkhead 66. As is understood by those skilled in the art, low-order failure typically includes a combustive reaction of high explosives. Combustive reaction of the high explosives can destroy any other high explosive which comes into contact with such a combustive reaction by initiating the combustive reaction in the high explosive which comes into such contact. The present invention provides a bulkhead which can be penetrated only by explosive detonation of the first 64 or the second 54 initiator charges, so that low-order failure of one detonating system will not of itself cause the entire perforator (12 in FIG. 1) to fail. It is usually possible to correctly detonate the perforator 12 by actuating the second firing head 18 even if the first firing head (16 in FIG. 1) fails to cause detonation of the perforator 12, or if the first detonating cord 62 undergoes a low-order failure.

Those skilled in the art will be able to devise alternative embodiments of the present invention which do not depart from the spirit of the invention described herein. The scope of the invention should therefore only be limited by the claims appended hereto.

What is claimed is:

1. An apparatus for initiating a wellbore perforator, comprising:

a first firing head attached to said perforator, said first firing head for generating a first explosive signal when a first actuation signal is applied to said first firing head;

a second firing head attached to said perforator, said second firing head for generating a second explosive signal when a second actuation signal is applied to said second firing head;

first means for transferring said first explosive signal to shaped charges in said perforator, said first means comprising a first bulkhead interposed between said shaped charges and said first means, said first bulkhead for preventing transfer of low order initiation of said first means to said shaped charges; and second means for transferring said second explosive signal to said shaped charges in said perforator, said second means comprising a second bulkhead interposed between said shaped charges and said second means, said second bulkhead for preventing transfer of low order initiation of said second means to said shaped charges, said first means for transferring and said second means for transferring isolated from each other so that initiation of one of said means for transferring does not cause initiation of the other of said means for transferring.

2. The apparatus as defined in claim 1 wherein said first firing head comprises a pressure actuated firing head.

3. The apparatus as defined in claim 1 wherein said first firing head comprises a percussively actuated firing head.

4. The apparatus as defined in claim 1 further comprising a time delay interposed between said first firing head and said first means for transferring.

5. The apparatus as defined in claim 1 wherein said second firing head comprises a pressure actuated firing head.

6. The apparatus as defined in claim 1 further comprising a time delay interposed between said second firing head and said second means for transferring.

7. The apparatus as defined in claim 1 wherein said first means comprises a transfer shaped charge adapted to penetrate said first bulkhead upon detonation of said transfer shaped charge.

8. The apparatus as defined in claim 1 wherein said second means comprises a transfer shaped charge adapted to penetrate said second bulkhead upon detonation of said transfer shaped charge.

* * * * *